United States Patent [19]

James

[11] Patent Number: 4,706,576

[45] Date of Patent: Nov. 17, 1987

[54] INTERLOCKING PLASTIC SHELVING SYSTEM

[76] Inventor: Barry A. James, 7720 S. Poplar Way, Englewood, Colo. 80012

[21] Appl. No.: 844,820

[22] Filed: Mar. 27, 1986

[51] Int. Cl.[4] ..... A47B 3/00

[52] U.S. Cl. ..... 108/111; 108/106; 108/107; 108/110; 108/901

[58] Field of Search ..... 108/111, 107, 110, 148, 108/106, 151, 108, 901; 211/190, 134, 153, 182, 191; 248/511

[56] References Cited

U.S. PATENT DOCUMENTS

| | | | |
|---|---|---|---|
| Re. 28,293 | 1/1975 | Bustos . | |
| 3,192,099 | 6/1965 | Beckman et al. . | |
| 3,323,656 | 6/1967 | Weiss et al. . | |
| 3,424,111 | 1/1969 | Maslow . | |
| 3,511,191 | 5/1970 | Barry, Jr. et al. . | |
| 3,604,369 | 9/1971 | Maslow . | |
| 3,834,549 | 9/1974 | Burg et al. | 108/111 |
| 3,845,864 | 11/1974 | Heinrich . | |
| 3,927,769 | 12/1975 | Maslow et al. . | |
| 3,939,987 | 2/1976 | Bustos et al. . | |
| 3,981,251 | 9/1976 | Bamberg | 108/156 X |
| 3,985,083 | 10/1976 | Pofferi | 108/111 |
| 4,015,545 | 5/1977 | Kurokawa . | |
| 4,240,557 | 12/1980 | Dickens . | |
| 4,397,247 | 8/1983 | Lemelson | 108/901 X |
| 4,467,927 | 8/1984 | Nathan | 108/111 X |
| 4,527,490 | 7/1985 | Tipton et al. | 108/64 |

*Primary Examiner*—James T. McCall
*Attorney, Agent, or Firm*—Gregg I. Anderson

[57] ABSTRACT

A shelving system including a plurality of parallel horizontally oriented shelves releasably and securely connected to four upright posts is disclosed. The releasable connection of the shelf to the post is achieved by use of corner connectors which fit into corner notches of the shelf. The corner connector includes a male segment and a female segment which mate to each other and fit into said post at step locator positions along the length of the post. Complimentary tooth and channel configurations of the mated corner connector and the corner notches of the shelf interlock the shelf to the corner connector and then to the post. The shelves are connectable to and releasable from the posts between shelves already mounted on the posts.

24 Claims, 16 Drawing Figures

INTERLOCKING PLASTIC SHELVING SYSTEM

BACKGROUND OF THE INVENTION

1. Field of the Invention

The present invention relates to shelving systems for storing food, medicines and other bulk items. More particularly, the present invention relates to a storage and transport system wherein shelves are adjustably mounted at selected locations along the height of posts supporting the shelves. The mounting between the post and the shelves interlocks the shelf to the post in a positive fashion that will support the weight of the shelf and merchandise stored thereon.

2. Description of the Prior Art

Many shelving systems are shown in the prior art including interlock structures at the corner of shelves to lock the shelf in position along vertical support posts. L. Maslow (U.S. Pat. No. 3,424,111) shows a split compression connector of frustoconical shape which split connector fits on a post and then through an aperture in a plastic shelf. The thickness of the shelf at the outer edges is greater than the thickness of a central area in Maslow. R. Bustos (U.S. Pat. No. Re. 28,293) teaches a plastic shelf construction mounted on uprights or posts inserted through an aperture in the shelf having a flat face and a tapered face. The shelf of Bustos is specifically contemplated for merchandise display, i.e., soft drink products. The shelf has a thickened periphery and a central grid portion. Another adjustable shelf patent to L. Maslow (U.S. Pat. No. 3,604,369) has grooved uprights to engage a tapered face member of the shelf. A tapered sleeve slides into a frictional fit with the tapered face to secure the upright to the shelf.

W. Nathan (U.S. Pat. No. 4,467,927), W. Heinrich (U.S. Pat. No. 3,845,864) and B. Weiss, et al. (U.S. Pat. No. 3,323,656) all teach various shelf constructions. Nathan shows a grid construction. Heinrich shows a foam core construction for a shelf. Weiss shows a corrugated shelf having multiple layers.

J. Barry, Jr., et al. (U.S. Pat. No. 3,511,191), L. Dickens (U.S. Pat. No. 4,240,557) and R. Bustos, et al. (U.S. Pat. No. 3,939,987) all teach various plastic foam pallet and shelf supports that are of general interest.

An extruded plastic shelf assembly, including wall portions and shelf portions is seen in M. Kurokawa (U.S. Pat. No. 4,015,545). A corrugated plastic foam core for a lightweight furniture structure having shelving and other applications is seen is R. Beckman, et al. (U.S. Pat. No. 3,192,099).

L. Maslow, et al. (U.S. Pat. No. 3,927,769) shows a ribbed construction for a metal shelf, though other suitable materials are also suggested.

OBJECTS AND SUMMARY OF THE INVENTION

It is the principal object of the present invention to provide a lightweight and strong plastic shelving system.

It is a related object of the present invention to provide a plastic shelving system for transport and storage of merchandise where one or more shelves can be added or removed without disassembly of the shelving system.

It is a further related object of the present invention to provide a shelving system with adjustable height shelves wherein a plastic connection system between the post and the shelves is strong enough to support heavy loads.

It is another related object of the present invention to provide a plastic shelving system with a unique shelf configuration to achieve high strength.

In accordance with the objects of the invention, a shelving system includes a plurality of horizontal shelves connected and locked to upright support posts, which shelves carry merchandise on the shelves. Each of the shelves is of generally rectangular plan view, each of the four corners notched for receipt of a pair of corner segments which mate to each other. The corner segments fit around the posts and the shelves are hung or suspended on the corner segments in a cantilever support. A shelf is insertable or removeable from between two existing shelves and secured to the posts without moving an existing shelf.

The posts include spaced apart slots which receive like ledges formed on the corner segments. The corner segments are each of generally triangular plan view to fit together in a male-female connection of square configuration having an aperture therethrough, in which aperture the post fits.

The shelf is, like the remainder of the shelving system, constructed of high strength, high density plastic. It includes a central area of gradually thinning thickness from side and front and back edge surfaces. The bottom surface of the shelf's central area follows a particular curvature at any longitudinal or lateral section taken therethrough.

DESCRIPTION OF THE PREFERRED EMBODIMENTS

Figure 1:
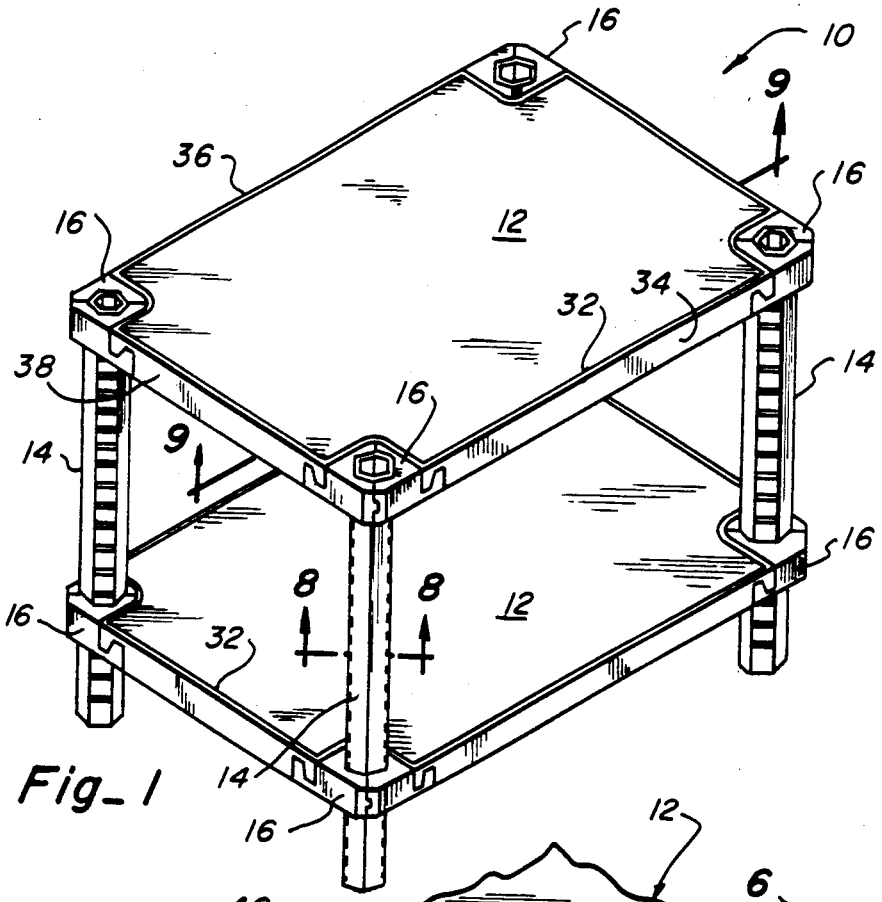
FIG. 1 is a perspective view of the shelving system of the present invention.

A shelving system 10 is seen is FIG. 1 to include a number of shelves 12 releasably and securably connectable to upright posts 14. The shelves 12 can be inserted or removed from between shelves already mounted to the posts 14 and connected to the posts 14 at any one of several positions along the length of the post 14, as will be described shortly.

Each shelf 12 is releasably secured to each of the four posts 14 by a corner connector 16. Unlike the prior art, apertures through the shelf are not used to receive the post for connection purposes. By using the corner connectors 16, the shelves 12 can be connected to the posts 14 between shelves already mounted to the posts without moving the previously mounted shelves.

Figure 2:
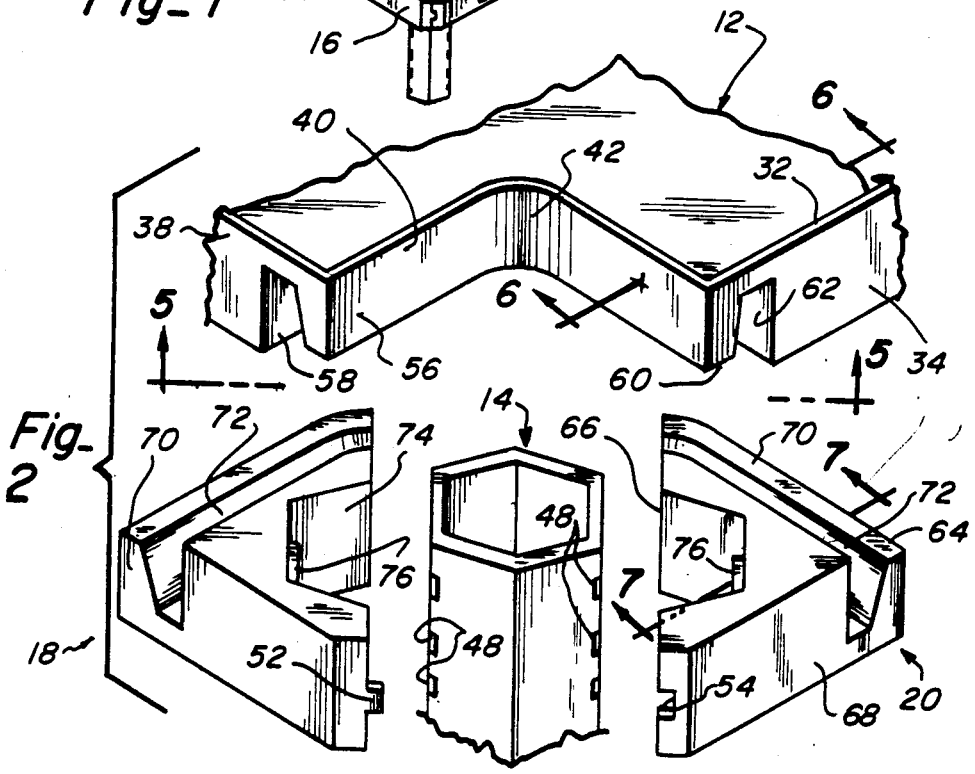
FIG. 2 is an enlarged exploded perspective view of a cantilever support connection between a shelf, a post and corner segment connectors of the invention shown in FIG. 1.

Each corner connector 16 is comprised of a male segment 18 and a female segment 20. (FIG. 2). To connect the shelf to the posts, the male and female segments 18 and 20 are placed or mated together around one of the posts 14 and then one of the shelves 12 is hung or supsended onto the corner connector thereby formed. The male and female segments 18 and 20 are held together about the post 14 by the connection to the shelves 12 and to each other and the weight of merchandise on the shelves. The segments 18 and 20 are secured to the post 14, preventing any vertical movement of the connector 16 and the shelves 12 relative to the post 14.

Figure 9:
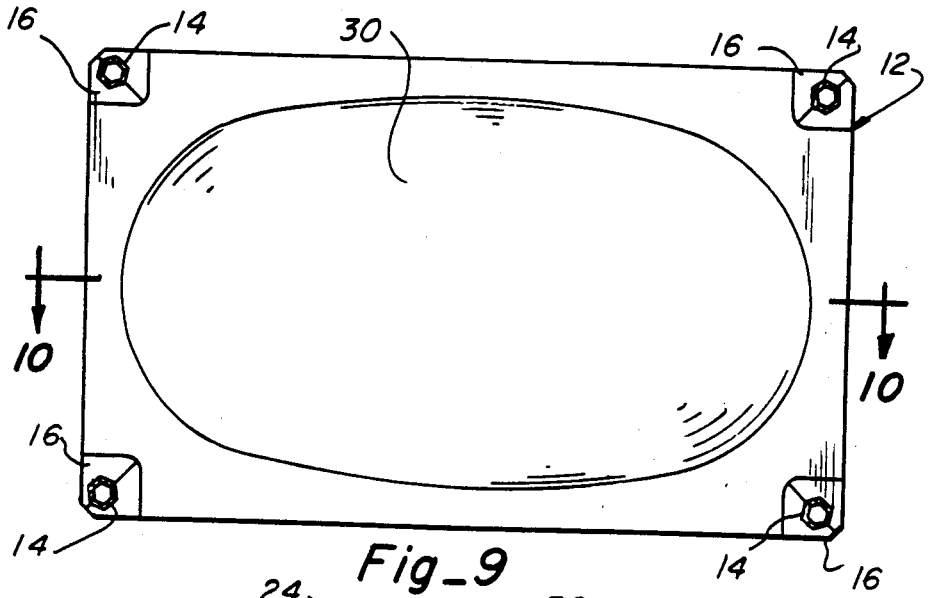
FIG. 9 is a sectional view taken in the plane of line 9—9 of FIG. 1.
Figure 10:
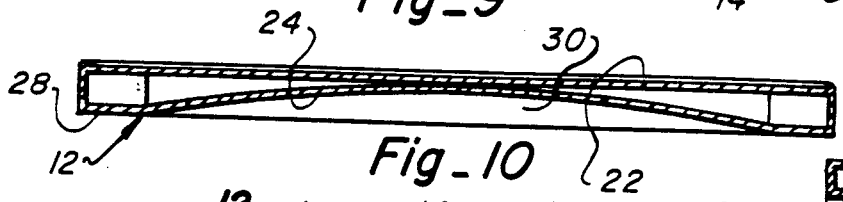
FIG. 10 is a sectional view taken in the plane of line 10—10 of FIG. 9.
Figure 11:
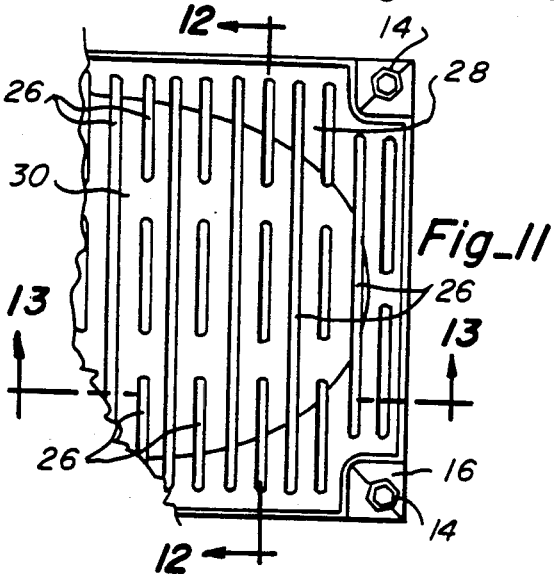
FIG. 11 is a fragmentary bottom plan view of a first alternative embodiment of the shelf of the invention shown in FIG. 1.
Figure 12:
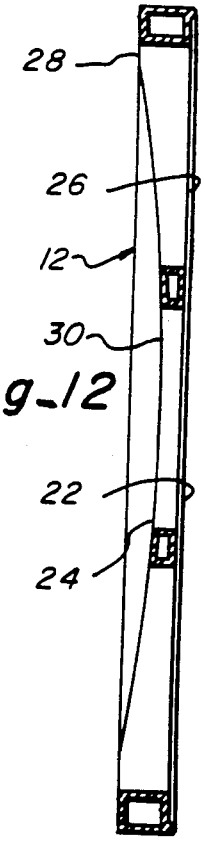
FIG. 12 is a sectional view taken in the plane of line 12—12 of FIG. 11.
Figure 13:
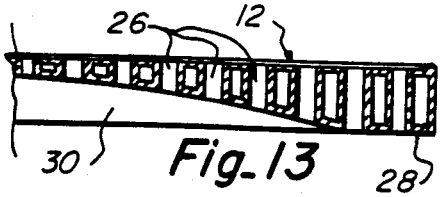
FIG. 13 is a fragmentary sectional view taken in the plane of line 13—13 of FIG. 11.
Figure 14:
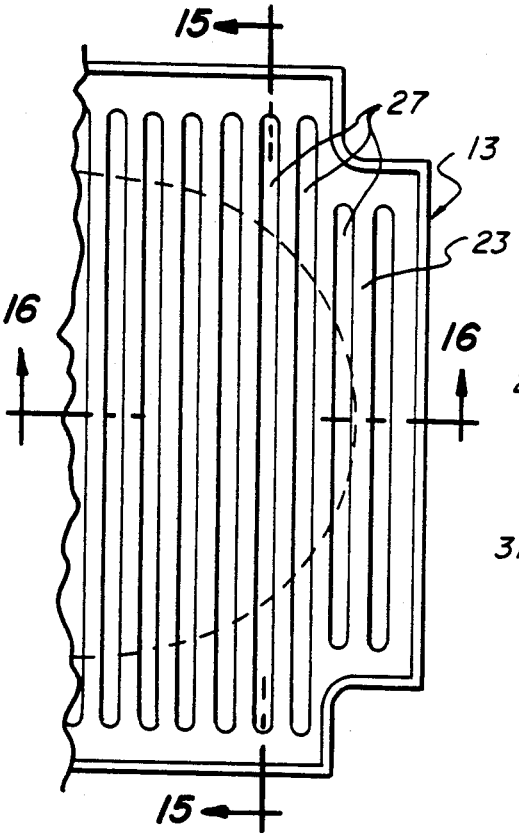
FIG. 14 is a top plan view of a second alternative embodiment of the shelf of the invention shown in FIG. 1.
Figure 15:
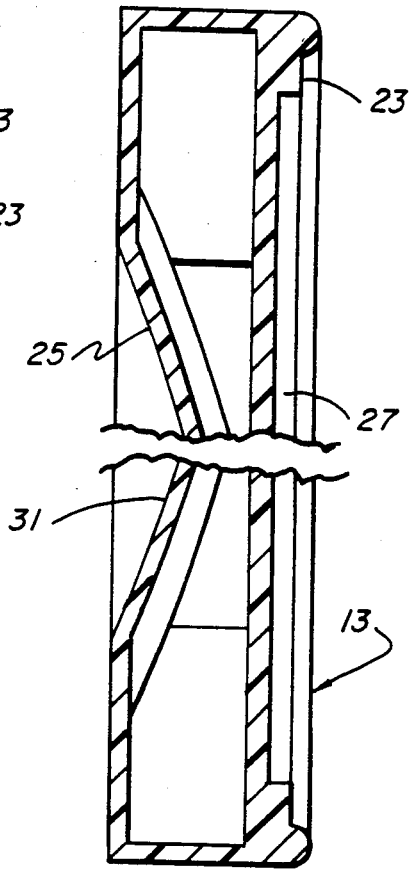
FIG. 15 is a fragmentary sectional view taken in the plane of line 15—15 of FIG. 14.
Figure 16:
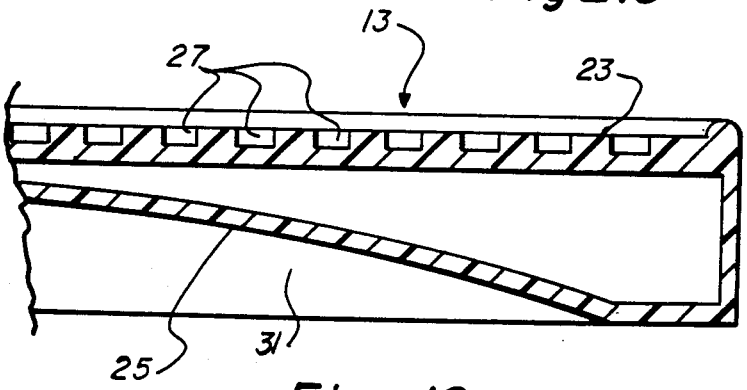
FIG. 16 is a fragmentary sectional view taken in the plane of line 16—16 of FIG. 14.

The shelves 12 are made of high strength, high density plastic, as are the posts 14 and the corner connector 16. The shelf 12 has a particular geometric configuration in a central area 30 on the bottom surface to give strength. (FIGS. 9 and 10). Each of the shelves 12 includes a top sheet 22 and lower sheet 24. In a preferred first alternative embodiment, slots or louvers 26 are formed through the top and lower sheets 22 and 24, for the purpose of allowing air to circulate around the merchandise. (FIGS. 11, 12 and 13). For food merchandise this is critical to avoid heat buildup and the likelihood of spoilage. A second alternative embodiment is embossed with raised ribs 27 for the same reason. (FIGS. 14–16). The ribs 27 are formed in the top sheet 23 extending laterally across the shelf 13. A bottom sheet 25 is spaced apart a set distance from the top sheet 23 as in the preferred embodiment of the shelf 12. A central area 31 corresponds to the central area 30 in shape and curvature.

Figure 3:
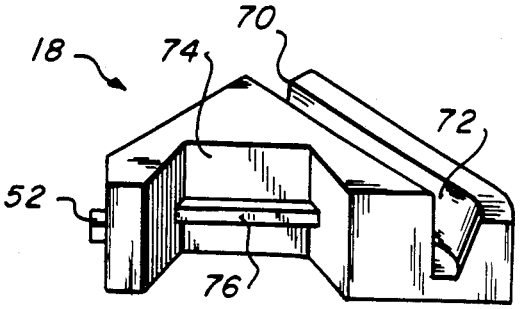
FIG. 3 is a perspective view of a male corner segment connector shown in FIG. 2.
Figure 4:
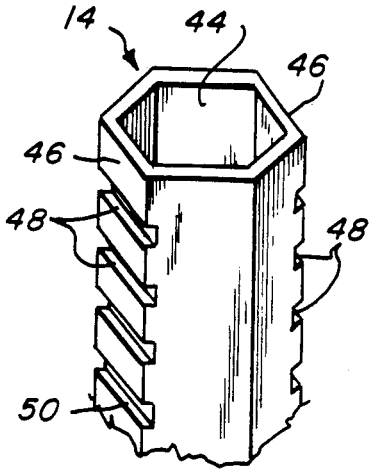
FIG. 4 is a perspective view of the post shown in FIG. 2.
Figure 5:
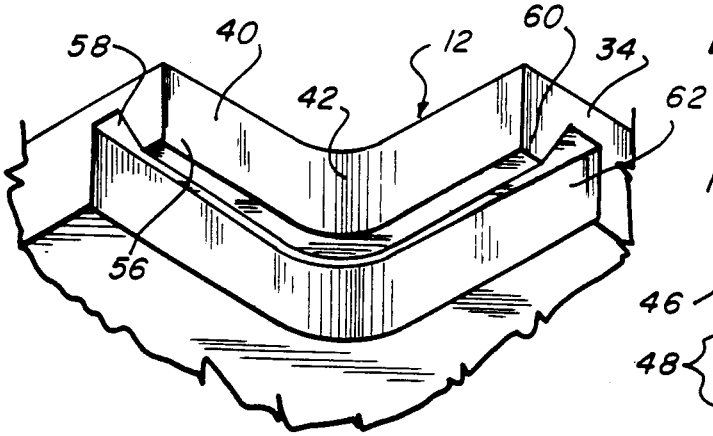
FIG. 5 is a fragmentary bottom perspective view of the shelf shown in FIG. 2.
Figure 8:
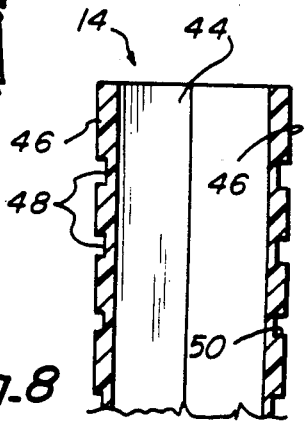
FIG. 8 is a sectional view taken in the plane of line 8—8 of FIG. 1.
Figure 6:
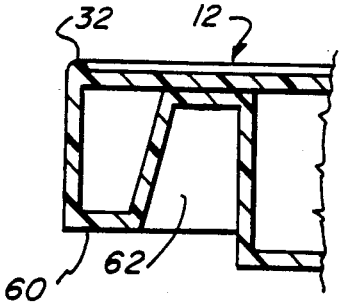
FIG. 6 is a sectional view taken in the plane of line 6—6 of FIG. 2.
Figure 7:
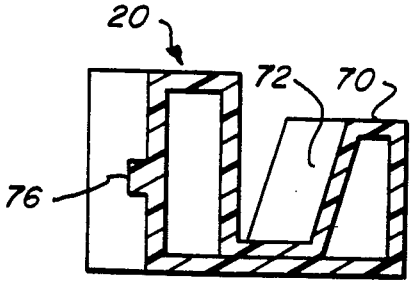
FIG. 7 is a sectional view taken in the plane of line 7—7 of FIG. 2.

The lower sheets 22 and 24 are formed in an upwardly concave configuration so that the central areas 30 and 31 have less thickness than an outer flat area 28. The shelf is thinnest at the center. In any longitudinal or lateral section through the central areas, the bottom surface of the lower sheets follow the curvature of a portion of an ellipse. The central areas may be described as concave ellipsoid in shape. In a cartesian coordinate system with the origin at the center of the ellipse, the major axis on the x axis and the minor axis on the y axis, the equation for the bottom surface of the central area is of the form:

$$\frac{y2}{a2} + \frac{x2}{b2} = 1$$

where "a" is half the major axis and "b" is half the minor axis. Because of the geometric relationship described, the central area 30 of FIG. 9, at a lateral cross section (FIGS. 12 and 15) and at a longitudinal cross section (FIGS. 3, 10 and 16), follows a portion of the curve of the same ellipse.

The shelves 12 are very strong as a result of the concave elliptical shape of the central areas 30 and 31. (FIGS. 10, 12, 13, 15 and 16). A twenty-one by forty-eight inch shelf is capable of supporting a six hundred pound load.

Returning now to the embodiment of FIGS. 1 through 10, each of the shelves 12 includes a raised peripheral lip 32 extending around the outer edge. The generally rectangular shelf 12 is approximately one inch thick at the outer periphery thereof, a front edge surface 34 and rear edge surface 36 extend parallel to each other while the side of each shelf has parallel side edge surfaces 38. A corner surface 40 of the shelf 12 forms the surface of a corner notch 42. The corner surface extends through a right angle, the corner surface perpendicularly intersecting one of the side surfaces 38 and either the rear surface 36 or the front surface 34, as seen in FIG. 2.

The corner notch 42 is shaped and dimensioned so as to mate with the corner connector 16. (FIG. 1). Once the corner notch 42 is mated with the corner connector 16 and the shelf 12 hung on the connector 16, the shelf has a rectangular configuration.

Each of the posts 14 (FIGS. 4 and 8) is of elongated tubular construction. Each of the posts is preferably of an hexagonal cross section. Parallel opposed surfaces 46 of each of the posts have locator slots 48 formed or otherwise machined therein. The slots are horizontal, each pair of slots lying in a plane perpendicular to a longitudinal axis of the post. The locator slots 48 are used to select the height at which each of the shelves 12 is connected to the posts 14. Mating the corner connector 16 around the post 14 and hanging the shelf 12 on the connector 16 allows the weight of the shelving system 10 to rest on steps 50 of the posts adjacent to the locator slots 48. The slots receive ledges 76 of the segments 18 and 20, the ledges resting on the steps 50, supporting the shelves and locking the shelves in position against vertical movement.

The corner notch 42 permits the shelf 12 to be inserted between a pair of shelves 12 already mounted to the posts 14. Corner connectors 16 are previously secured about the posts 14 and the inserted shelf 12 is hung thereon. Similarly, a shelf can be removed without removing the shelf above the shelf that is to be removed. Because all the prior art shelving includes apertures through the shelf through which the posts fit, a shelf can not be inserted or removed without removing other shelves. This is time consuming because the shelves to be moved must be unloaded and several release and reconnect operations must be done.

The shelf 12 at the corner notch 42 includes a downwardly projecting continuous tooth 56 extending around the corner notch 42 and defining the corner surface 40. (FIG. 2). The tooth includes a crown 60 and is spaced apart from a vertical surface 62 of the shelf by an upwardly open continuous channel 58.

Each of the segments 18 and 20 is of generally triangular plan view and includes an inner surface 64, a mating surface 66 and an outer surface 68. In the preferred embodiment the male and female segments 18 and 20 are substantially identical. The male segment includes a tab 52 which projects into an indent 54 of the female segment 20. The inner surface 64 fits flush against the vertical surface 62 of the shelf 12. The mating surfaces 66 fit flush against each other when the segments 18 and 20 are placed together to form the corner connector 16. The outer surface 68 defines the exterior of the shelving system 10 and is contiguous with one of the rear or front surfaces 34 and 36 and a side surface 38 when the shelving system 10 is assembled.

Each segment 18 and 20 also includes an inwardly projecting tooth 70 extending along the respective inner surfaces 64 of the male and female segments 18 and 20. The tooth 70 fits into the channel 58 of the shelf 12. An upwardly open channel 72 of each of the segments extends parallel to the tooth 70 between the outer surface 68 and mating surface 66 of each segment and receives the tooth 56 of the shelf 12.

Each of the segments 18 and 20 includes an inset opening 74 defining three sides of the hexagonal shape of the post 14. At surfaces of the inset opening corresponding to the opposed surfaces 46 of the posts 14, a ledge 76 is integrally formed. Placing the segments 18 and 20 together involves insertion of the ledges 76 into corresponding locator slots 48 of the post 14. The tab of the male segment 18 fits into the indent of the female segment 20 to form the corner connector 16. The tooth 56 of the shelf 12 fits into the channel 72 of the corner connector 16 and the tooth 70 of the corner connector 16 fits into the channel 58 of the shelf.

The shelving system 10 thus formed is seen to assembly easily. The fit between the male and female segments 18 and 20 is tight enough that the corner connector 16 is held in position about the post 14 at the chosen slots 48. Similarly, the fit between the ledges 76 and slots 48 is tight, aiding in holding the corner connector 16 in place in supporting the shelf 12 when it is hung on the connector 16. The shelf 12 is easily inserted between the posts 14 and dropped onto the corner connector. The corner notch 42 draws the male and female segments 18 and 20 together to more tightly grasp the post 14. The ledges 76 are thereby held in the slots 48.

Although the invention has been described with a certain degree of particularity, the invention is most readily seen in the appended claims and their equivalents.

What is claimed is:

1. A shelving system comprising in combination:

an upright post of hexagonal transverse cross section including a plurality of steps formed along the length of said post;

a shelf having at a periphery thereof at least three corner notches each forming a downwardly projecting tooth integrally formed with said shelf and extending around the corner notch at a spaced distance from said shelf defining a downwardly open channel; and a corner connector consisting of a male corner segment and a female corner segment mated together about said post, each of said segments having an insert opening formed in a mating surface of said segment which defines an aperture through said corner connector when the corner is formed by joining the male and female segments, each of said segmets with an upwardly projecting tooth extending along an inner surface of each segment, the upward tooth integral with the segment and adjacent to a second upwardly open channel for receiving said first mentioned tooth, said second channel receiving said downwardly projecting tooth of said shelf and said first channel of said shelf receiving said upwardly projecting tooth in an interlocking relationship between said shelf, said connector and said post, which insert opening fits about said post and connects said connector to said post at one of said steps.

2. The invention as defined in claim 1 wherein said segments have a ledge integrally formed therewith within said inset openings which ledge fits onto one of said steps.

3. The invention as defined in claim 1 wherein said corner segments are of substantially triangular plan view, said corner connector is of substantially square plan view and said corner notch is substantially square to receive said corner connector in said interlocking relationship.

4. The invention as defined in claim 2 wherein said post is of hexagonal transverse cross section and said steps are formed on opposite parallel surfaces thereof, said segments each having a ledge to rest on respective opposed steps of said post.

5. A shelving system comprising in combination an upright post having two opposed parallel surfaces extending along the length thereof, each of said parallel surfaces having means for connecting said post to a corner connector which connects about said post at any selected position along the length of said post, said connector projecting away from said post and terminating in suspension means cantilevered from said post for receiving complementary connection means formed on a shelf.

6. The invention as defined in claim 5 wherein said corner connector includes two segments of generally triangular plan view which fit about said post and have a mating surface therebetween, an outer edge surface of said segments essentially co-planar with like outer edge surfaces of said shelf and an inner edge surface which abuts with a corner surface of said shelf.

7. The invention as defined in claim 5 wherein said suspension means on said corner connector includes an upwardly projecting tooth spaced apart from said corner connector by an upwardly open channel and said shelf connection means includes a downwardly projecting tooth for fitting into said inwardly open channel and a downwardly open channel of said shelf for receiving said upwardly projecting tooth.

8. The invention as defined in claim 6 wherein each of said male and female segments include a ledge projecting laterally therefrom for insertion into slots formed in said opposed surfaces, said slots comprising means for vertically locating said shelf on said post.

9. The invention as defined in claim 5 wherein said shelf is formed of a pair of parallel plastic sheets spaced apart a predetermined distance, said predetermined distance being greater at an outer periphery of said shelf than at the center of said shelf.

10. The invention as defined in claim 9 wherein a central area of said shelf of oval shape gradually thins to a minimum thickness essentially at the center of said oval.

11. The invention as defined in claim 9 wherein said upper and lower sheets have slots formed therethrough.

12. The invention as defined in claim 10 wherein said upper and lower sheets have slots formed therethrough.

13. The invention as defined in claim 9 wherein an upper sheet has ribs formed thereon.

14. The invention as defined in claim 10 wherein said upper sheet has ribs formed thereon.

15. A shelving system comprising in combination:

an upright post of hexagonal transverse cross-section, including, on opposed parallel surfaces thereof, a plurality of slots, a corner connector, including a male corner segment and a female corner segment mateable to each other about said post, said mated segments having means for engaging said slots along said post to hold said corner connector about said post at a selected vertical position along said post, said corner connector having means for hanging a shelf thereon, including an upwardly projecting tooth extending around the periphery of the corner connection spaced away from the corner connector by an upwardly open channel, said shelf having a notch formed thereon for each such corner connector and including connector means complementary to said suspension means, said connector means for said shelf including a downwardly projecting tooth formed on said shelf and a downwardly open channel, said upwardly open channel of said corner connector receiving said downwardly projecting tooth and said downwardly open channel of said shelf, and said shelf receiving said upwardly projecting tooth of said corner connector.

16. The invention as defined in claim 15 wherein said shelf includes an upper sheet of plastic integrally formed with a lower sheet of plastic, said lower sheet having a predetermined spaced relationship from said upper sheet at an outer periphery of said shelf, and said lower sheet having a central area which is closer to said upper sheet than at the outer periphery.

17. The invention as defined in claim 16 wherein said central area has a minimum distance between said upper and lower sheets at the corner of said shelf.

18. The invention as defined in claim 16 wherein the central area of said lower sheet is a concave ellipsoid.

19. The invention as defined in claim 17 wherein a portion of said lower sheet follows an arc of an ellipse in both longitudinal and lateral cross-sections.

20. A shelving system comprising in combination an upright post having two opposed parallel surfaces extending along the length thereof, each of said parallel surfaces having means for connecting said post to a corner connector having two segments of generally triangular plan view which fit about said post and having a mating surface therebetween, an outer edge surface of said segments essentially co-planar with like outer edge surfaces of said shelf and an inner edge surface abuts about a corner surface of said shelf, each of said parallel surfaces having means for connecting said post to said corner connector at any selected position along the length of said post, said connector projecting away from said post and terminating in means cantilevered from said post for receiving complementary connection means formed on said shelf.

21. The invention as defined in claim 20 wherein each of said segments includes a ledge projecting laterally therefrom for insertion into slots formed in said opposed surfaces, said slots comprising means for vertically locating said shelf on said post.

22. The invention as defined in claim 20 wherein said shelf is formed of a pair of parallel plastic sheets spaced apart a predetermined distance, said predetermined distance being greater at an outer periphery of said shelf than at a central area of said shelf, said central area of said shelf of oval shape, gradually thinning to a minimum thickness essentially at the center of said oval.

23. A shelving system comprising in combination an upright post having two opposed parallel surfaces extending along the length thereof, each of said parallel surfaces having means for connecting said post to a corner connector which connects about said post at any selected position along the length of said post, said connector projecting away from said post and terminating in means for receiving complementary connection means formed on a shelf, said shelf formed of an upper and lower plastic sheet spaced apart a pre-determined distance, said pre-determined distance being greater at an outer periphery of said shelf than at the center of said shelf, and said upper sheet having ribs formed thereon.

24. The invention as defined in claim 23 wherein a central area of said shelf is of generally oval shape and said upper and lower sheets are at a minimum distance apart from each other essentially at the center of said oval, said upper and lower sheets having slots formed therethrough.

* * * * *

UNITED STATES PATENT AND TRADEMARK OFFICE

CERTIFICATE OF CORRECTION

PATENT NO. : 4,706,576

DATED : November 17, 1987

INVENTOR(S) : Barry James

It is certified that error appears in the above-identified patent and that said Letters Patent is hereby corrected as shown below:

On the title page, Item [76] should read

-- Inventor: Barry James
7733 S. Poplar Way
Englewood, Colo. 80112 --.

Signed and Sealed this

Twenty-sixth Day of April, 1988

*Attest:*

DONALD J. QUIGG

*Attesting Officer*

*Commissioner of Patents and Trademarks*